United States Patent [19]

Dailey et al.

[11] Patent Number: 5,027,105

[45] Date of Patent: Jun. 25, 1991

[54] MOTION DETECTORS AND SECURITY DEVICES INCORPORATING SAME

[76] Inventors: Thomas A. Dailey, 6300 Carey, Cincinnati, Ohio 45224; Alfred A. Dailey, 3493 Sunbury La., Cincinnati, Ohio 45239; Richard J. Dailey, 7145 Laboiteaux Ave., Cincinnati, Ohio 45239

[21] Appl. No.: 165,289

[22] Filed: Mar. 8, 1988

[51] Int. Cl.[5] ..... G08B 13/14

[52] U.S. Cl. ..... 340/571; 340/566; 200/61.45 R

[58] Field of Search ..... 340/568, 571, 566, 573, 340/689; 338/157; 200/61.45 R, 61.52, 61.53

[56] References Cited

U.S. PATENT DOCUMENTS

| | | | |
|---|---|---|---|
| 4,057,791 | 11/1977 | Bimmerle et al. | 340/65 |
| 4,155,079 | 5/1979 | Chiu et al. | 340/571 |
| 4,204,202 | 5/1980 | Pai | 340/571 |
| 4,267,553 | 5/1981 | Vogelsanger et al. | 340/571 |
| 4,272,763 | 6/1981 | Chang et al. | 340/571 |
| 4,303,906 | 12/1981 | Weakley | 200/61.45 R |
| 4,418,337 | 11/1983 | Bader | 340/566 |
| 4,467,153 | 8/1984 | Jones et al. | 200/61.45 R |
| 4,584,569 | 4/1986 | Lopez et al. | 340/566 |
| 4,747,216 | 5/1988 | Kelly et al. | 340/689 |
| 4,884,067 | 11/1989 | Nordholm et al. | 340/573 |

*Primary Examiner*—Reinhard J. Eisenzopf
*Assistant Examiner*—Geoff Sutcliffe
*Attorney, Agent, or Firm*—Edmund S. Lee, III

[57] ABSTRACT

A security device for the prevention of theft is described. It comprises an alarm, a motion detector which provides a signal, effective through an electrical circuit for actuation of the alarm. The motion detector includes a tubular cylinder, a sphere and a tether which are conductive and connected in series across an electrical potential. Movement of the detector, from any initial orientation and in any direction results in an increase in contact resistance between the sphere and cylinder and generates a motion signal. After actuation of an arming switch, a motion signal energizes the alarm. Once armed, a disarming switch must be actuated to prevent or halt energization of the alarm. The device is detachably mounted on a brief case, with the switches on the exterior and connected by conductors to the remaining elements of the device mounted on the interior of the brief case. Delay means enable the brief case to be moved after arming and before disarming, without sounding the alarm, to facilitate its storage and retrieval. In an alternate embodiment, a switch, mounted on a flexible conductor permits energization of the alarm independently of the motion signal responsive means.

20 Claims, 4 Drawing Sheets

MOTION DETECTORS AND SECURITY DEVICES INCORPORATING SAME

The present invention relates to improvements in motion detectors and security devices in which they are incorporated.

Many prior proposals have been made for providing security devices which will sound an alarm, when there is unauthorized movement of an item, as would occur when an item is being stolen. Brief cases, and the like, are particularly subject to theft and many of the prior proposals are directed to the requirements for protecting such items.

The basic components of such devices, or systems, comprise an alarm, a motion detector and an electrical circuit, actuated by the motion detector, for energizing the alarm. Further, means are generally provided for disarming the alarm so that it won't be energized because of movement while it is being carried. The device is then selectively armed, when the brief case is set in a given position, and the protective feature desired.

While the disirability of such security devices is readily appreciated, their use has been relatively limited. Several reasons can be identified for this failure of more widespread use. These reasons include expense, inconvenience in use and accidental energization of the alarm, giving a false alarm.

There are other desirable features of such security devices, and motion detectors in general, which have not been fully met. These features include the capability of being operable from any initial orientation and that they be responsive to movement in any direction.

Accordingly, one object of the present invention is to provide an improved motion detector of the type which is operable from any initial orientation and which is responsive to movement in any direction.

Another object of the present invention is to increase the convenience of using security, or anti-theft, devices incorporated in brief cases, or the like.

A further object of the present invention is increase the utility and ease of use of security devices employed for theft prevention purposes.

Yet another object of the present invention is to attain the foregoing ends and further to reduce the costs of motion detectors and alarm systems in which they are incorporated.

In accordance with one aspect of the invention, a motion detector is provided which comprises two relatively movable, electrically conductive elements. These elements are adapted for connection, in series, across an electrical potential. When the motion detector is moved, there is relative movement between the two elements. This movement can be a separation of the two elements, or it can be a sliding movement, or it can be a rolling movement. In any of these events, the electrical resistance between the contacting surfaces of the two elements increases, even where they remain in physical contact with each other. This increase in electrical resistance, in effect, provides a signal indicative of movement of the detector, and, thus, any item to which it is attached.

In a more specific sense, the novel features of the invention are found in the provision of a container having an inner surface forming one of said conductive elements and the other conductive element is a clapper disposed therein. Further, a conductive tether connects the clapper to the container. The tether is spaced from the conductive inner surface of the container and is adapted for connection with the electrical potential source.

Other novel features are found in a clapper formed as a sphere, preferably having a relatively large mass which, advantageously, may be attained by use of a lead ball. It is also preferred that the tether be highly flexible so as to impose a minimum restraint on movement of the sphere.

Additional novel features are found in the use of a container formed by a tubular cylinder having end walls. The cylinder and end walls may be formed of a dielectric material, with the tether extending through one of the end walls.

Additional sensitivity may be obtained by employing an uneven, or irregular, conductive surface for the container. Advantageously this end may be attained by woven wire screening.

This improved motion detector finds utility in combination with an alarm and electrical circuit means for energizing the alarm in an anti-theft device. The electrical circuit means is responsive to an increase in resistance in the motion detector to energize the alarm. Preferably means are provided for latching the alarm in an energized state, once it is so energized.

The anti-theft device may also include arming and disarming means. When the brief case is carried in normal use, the device would be disarmed to prevent actuation of the alarm. The device is then armed when the brief case is set in a rest position where it might be subject to theft. Additional features are then found in the provision of delay means which permit the brief case to be manipulated, for a short period after arming. Thus the brief case may be disposed in a rest or storage position after arming, without energization of the alarm.

Other means are provided which delay energization of the alarm after there has been movement of the motion detector which would otherwise energize the alarm. Thus the brief case may be retrieved from a storage position, without having the alarm sound. That is, this delay is sufficient to permit disarming of the device before energization of the alarm.

These delay features also find utility in combination with other motion detectors.

Further features of the invention are found in the provision of a security device adapted for use in combination with a brief case, or the like. The device comprises a housing in which the alarm, motion detector and electrical circuit means are mounted. A separate key pad, or switch means, is connected by conductors to the housing. The key pad is detachably mounted on the exterior of the brief case and the housing is detachably mounted on the interior of the briefcase, with the conductors extending through the space between the opening defining portions of the brief case. This feature enables the anti-theft device to removed and then used for other purposes, as for example, mounting on another brief case, or as an intrusion sensor, by hanging it on the knob of an entry door.

Yet another feature of the invention is found in the provision of a switch for manually energizing the alarm. Preferably the switch is at the end of a flexible conductor. The security device can then be carried, unarmed, in a purses to provided protection against a snatch thief. With the connector threaded through the closed purse opening, the switch is in the user's hand to be actuated and sound the alarm in the event the purse is grabbed.

The above and other related objects and features of the invention will be apparent from a reading of the following description of the embodiments disclosed herein, with reference to the accompanying drawings, and the novelty thereof pointed out in the appended claims.

Figure 1:
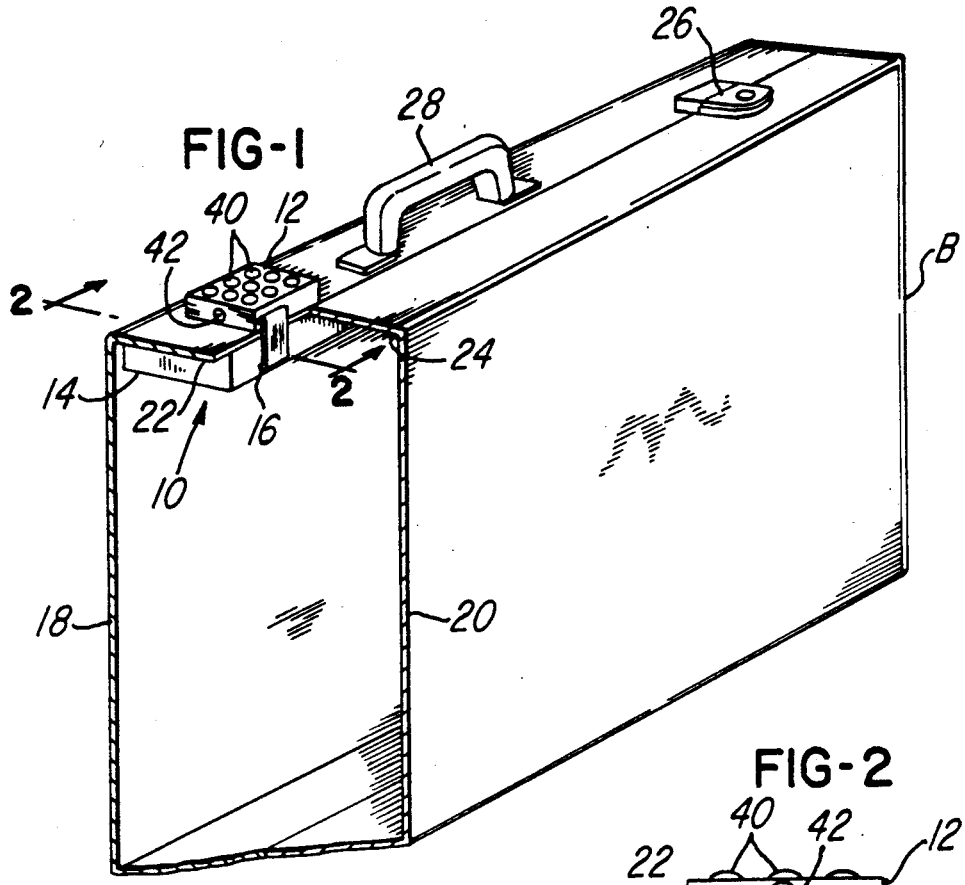
FIG. 1 is a perspective view, with portions broken away, of a brief case on which the present anti-theft device is mounted.
Figure 2:
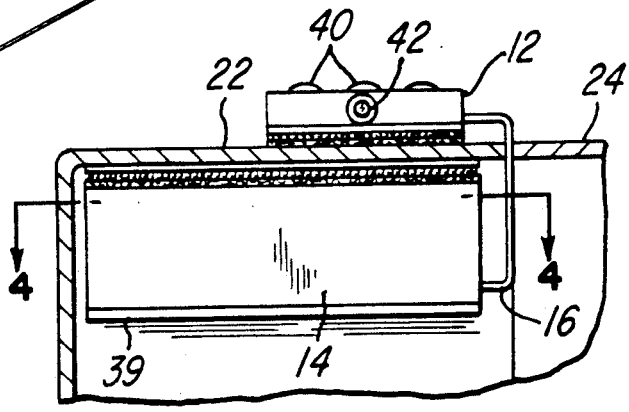
FIG. 2 is a section, on an enlarged scale, taken on line 2—2 in FIG. 1.

One of the preferred applications of the present invention is in the provision theft protection for brief cases and the like. A typical brief case B is illustrated in FIG. 1. The anti-theft device of the present invention is generally identified by reference character 10 and comprises a key pad 12 and a housing 14, interconnected by a ribbon type conductor 16.

The brief case B is of a well known type comprising a pair of rectangular, shells 18, 20, the lower sides of which are joined by hinges (not shown). In the closed position of the brief case, the top panels 22, 24 of the shells, are held in closed relation by a catches 26 (only one is shown). A carrying handle 28 may be pivotally mounted centrally on the top panel 22.

The housing 14 contains an alarm 30, a motion detector 32, electrical circuit components contained within a housing 34 and batteries 36, 38. The housing 14 is provided with a removable cover 39 to provide access to its interior.

The key pad 12 may be of well know construction wherein depression of a selected button, or buttons, 40 provides a switch function. The use of the key pad provides added security in that a knowledge of the proper buttons to depress is required for use of the device.

Briefly, the device 10 is armed by depressing the proper buttons 40. A light emitting diode 42, on the key pad 12 is then illuminated to indicate that the device is armed. After a time delay, any subsequent movement of the brief case, sensed by the motion detector 32, results in energization of the alarm 30. Persons in the area are thus alerted to an attempted theft. The alarm will continue sounding until the proper button, or buttons, 40 of the key pad 12 is depressed. Other operational features of the device will be later described.

The device 10 is, preferably, detachably mounted on the brief case B, permitting it to be used on other brief cases, or for other anti-theft purposes.

Figure 3:
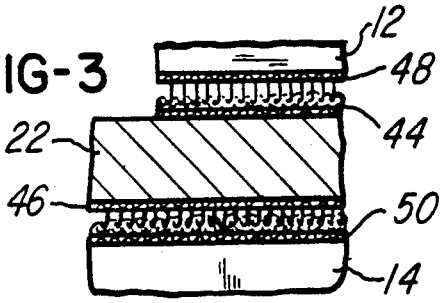
FIG. 3 is a fragmentary view, on a further enlarged scale, of a portion of FIG. 2.
Figure 4:
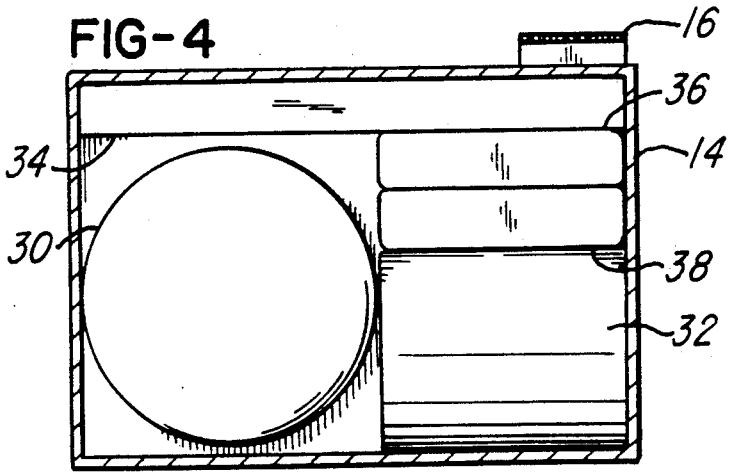
FIG. 4 is a section taken on line 4—4 in FIG. 2.

To this end Velcro fasteners are, preferably, employed as the mounting means. As illustrated in FIG. 3, these well known fasteners comprise fabric strips from which specially formed wires project. When these wires are meshed they provide a releasable gripping action.

Velcro fabric strips 44, 46 are adhesively secured to the upper and lower surfaces of the top panel 22 of the brief case B. A Velcro fabric strip 48 is adhesively secured to the lower surface of the key pad 12 providing for its releasable attachment to on the exterior of the brief case B. Similarly, a Velcro fabric strip 50 may be adhesively secured to the top surface of the housing 14, permitting its releasable mounting interiorly of the closed brief case.

In most commercially available brief cases, there is a finited clearance between the matching edges of the top panels (22, 24) of the shells forming the brief case. This permits interconnection of the key pad 12 and housing 14 by the ribbon connector 16. Thus the present device may be mounted on most brief cases without the necessity of the brief case being structurally modified.

Figure 5:
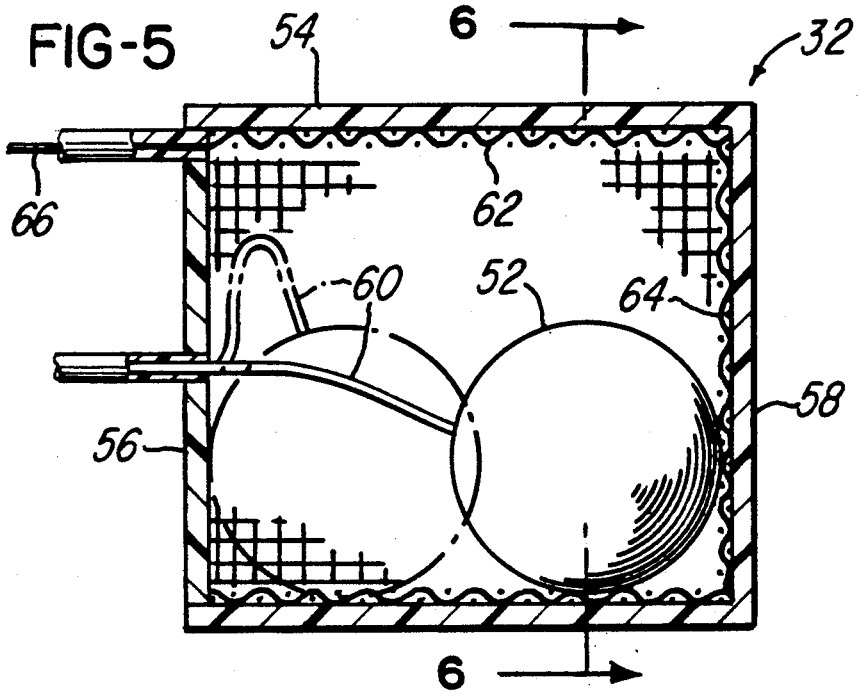
FIG. 5 is a longitudinal section of the motion detector employed herein.
Figure 6:
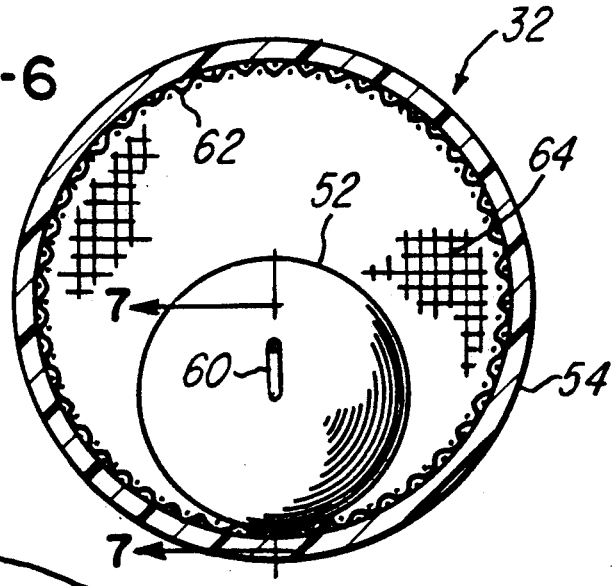
FIG. 6 is a section taken on line 6—6 in FIG. 5.
Figure 7:
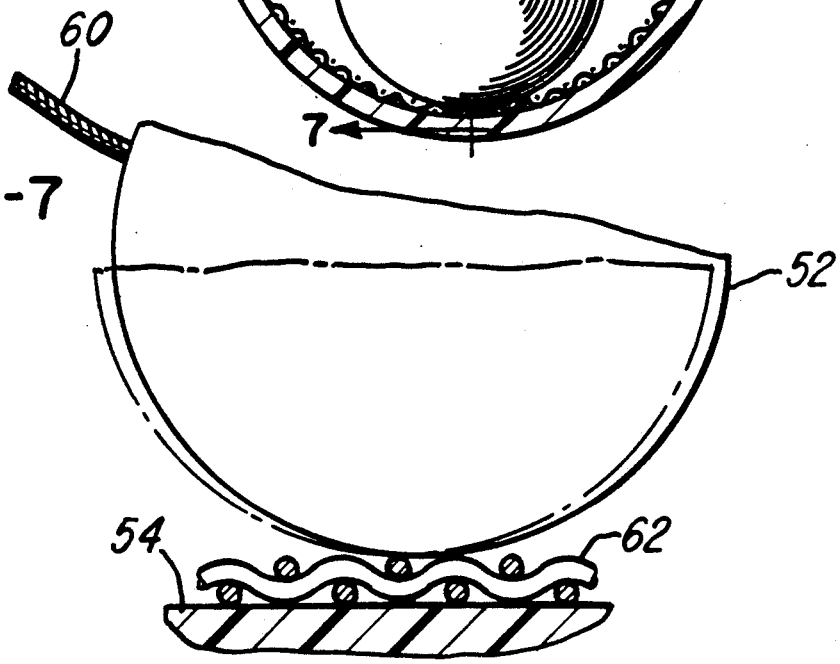
FIG. 7 is a section, on a greatly enlarged scale, taken on line 7—7 in FIG. 6.

Attention will next be directed to FIGS. 5-7 for a detailed description of the motion detector 32.

Structurally the detector 32 comprises a ball, or sphere, 52 disposed within a tubular, cylindrical housing 54 closed at its opposite ends by walls 56, 58. The cylinder 54 and end walls 56, 58 are preferably formed of a non-conductive dielectric material, conveniently a synthetic resin such as polyethylene.

An electrical conductor 60, insulated exteriorly of the detector, extends through the end wall 56 and is connected to the sphere 52.

The interior surface of the cylinder is lined with woven wire screen 62. The interior surface of the end wall 58 is also lined with a woven wire screen 64. The screens 62, 64 are electrically conductive and interconnected. A second conductor 66 extends through the end wall 56 and is connected to the screen 62, being insulated exteriorly of the motion detector.

In a physical sense, motion is detected by relative movement between the sphere 52 and the cylindrical container within which it is disposed. Such relative movement is enhanced by employing a sphere with a relatively large mass. Thus it is preferred that the sphere 52 be formed of lead, which is also sufficiently conductive for present purposes.

Further, it is preferred that the electrical conductor 53, connected to the sphere 46, should be highly flexible, so as to impose a minimum restraint on movement of sphere relative to its container.

To exemplify these relationships, effective sensing of movement has been obtained with a lead sphere 52 having a ½ inch diameter disposed within a screen lined cylinder having an interior diameter of ⅞ inch. This is midway within the preferred range for this relationship, namely that the interior cylinder surface diameter be between 1.5 and 1.75 times the sphere diameter. Also it is preferred that the length of the interior of the cylinder approximate twice the diameter of the sphere 52. One reason for the preferred ranges is that greater wear life is obtained with movement of the sphere thus relatively restricted.

Further, it has found that the portion of the conductor 60 provides an acceptable minimal restraint on movement of the sphere 52 when formed of two or three strands of a standard, 18 gage twisted strand, copper wire.

Brass screening formed of 26–28 gauge wires, with approximately 14 wires per inch, in each direction, has been found satisfactory for the screens 62 and 64.

When the motion detector is at rest, current may flow from conductor 60 to conductor 68 through the surface contact between the sphere 52 and the screen 62 and/or the screen 64 (dependent upon the initial orientation of the detector). The level of current flow is an inverse function of the contact surface resistance between the sphere 52 and the portion of the screen 62 (or 64) in contact therewith.

The motion detector 32, in one sense, is an accellerometer, or decellerometer, in that relative movement between the sphere 46 and its container occurs, during acceleration, because of the tendency of the sphere to remain at rest, and, during deceleration, due to the tendency of the sphere to continue in motion in a given direction.

This is to point out that the present motion detector is operative to sense movement in any direction. Further this universal responsiveness is provided from any initial orientation of the detector.

This is partially indicated by the phantom showing of the sphere 52 in FIG. 5. This is the position the sphere would assume in a vertical orientation of the detector, with the end wall in an upper position. The restraint of the conductor is sufficient to maintain the sphere in conductive contact with the screen 62. Alternatively, additional screening may be provided on the end wall 56 to provide this conductive contact.

It is a recognized phenomenon that, where two conductors are brought into contact, there is a finite, intersurface contact resistance. It is also recognized that this resistance varies inversely with the pressure maintaining contact between the surfaces of the two conductors. It is further believed that where there is relative movement, including rolling movement, between conductors, that the intersurface, contact resistance increases.

This belief has been given credence by the use of a cylinder having a smooth, conductive inner surface, as opposed to the irregular surface provided by the described use of screens. It was found that, where the detector sphere rolled, or slid, relative to the smooth cylinder surface, the alarm was energized. This is to say that, despite their being continuous, nominal contact between the sphere and the conductive inner surface of the cylinder, there was a sufficient increase in intersurface resistance to reduce current flow, if not actually interrupt that flow, to a point wherein the circuit responded to such reduction and energized the alarm.

As indicated, the use of a screen is preferred. FIG. 7 illustrates that contact between the sphere 46 and screen 54 occurs at a plurality of spaced, contact points. When there is rolling contact of the sphere, indicated by the broken line showing, certain of these contact points are lost, or opened, and rolling contact occurs relative to other contact points, as new contact points are made, or closed. This configuration has been found to have a high degree of sensitivity in detecting movement at relatively low rates of acceleration, or deceleration.

The use of a woven wire screen to provide an irregular surface with multiple contact points with the sphere is preferred because of the convenience and economy in employing a commercially available product. Alternatively, a metallic cylinder, with closed ends could be employed, with dimples, or other surface irregularities formed therein. Appropriate insulation would be employed in light of the fact that the present "detector switch" is in a "hot" line of the electrical circuit.

Another alternative would be to provide a plurality of small projections on the surface of the sphere 46 to obtain multiple contact points between the sphere and the cylinder.

It will be noted that the sensitivity of the present device is substantially unaffected by oxidation. This is to say that most metals tend to react with air and form oxide films which have a relatively high resistance. Such films, on the screen or ball surfaces could increase intersurface resistance which could have a value as great as obtained by sphere movement. This problem is not normally encountered due to the continuous movement of the sphere which abrades these surfaces so that there is no substantial buildup of these oxide films.

To summarize, the motion detector (32) comprises a clapper conductive member (sphere 52) connected to a container by a tether (wire 60). Movement of the detector results in relative movement between the clapper and the inner surface of the container. In a broader sense, there are two conductive elements. Movement of the detector results in relative movement between these two elements. This relative movement, in turn results in an increase in electric resistance to current flow therebetween. If the elements actually separate, as can occur, resistance becomes infinitely high, as in an open circuit.

When these elements (the sphere and the screens 62 and/or 64) are connected across an electrical potential, this increase in resistance provides a signal indicating movement of the detector and any item to which the detector is attached. The manner in which this increased resistance signal may be employed to actuate an alarm will be described with reference to the electric circuit shown in FIG. 11.

Figure 10:
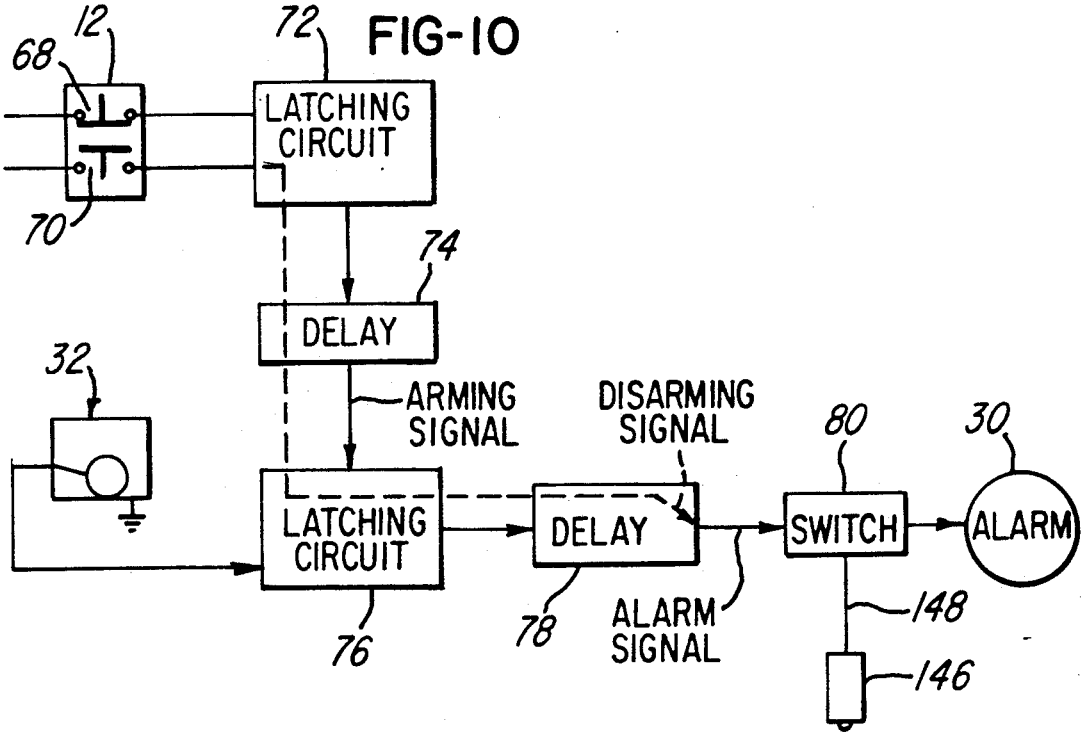
FIG. 10 is a block diagram of the functional elements of the present device.

Before describing that circuit, reference is made for FIG. 10 for a description of its functions.

The key pad 12, in effect, comprises two switches, 68 and 70, which are actuated by the buttons 40. Switch 68 is an arming switch which is actuated when it is desired to protect the brief case against theft. After being armed, subsequent movement of the brief case, as in the case of theft, will result in sounding of the alarm 30. Switch 70 is a disarming switch which may be actuated to deenergize, or prevent energization of, the alarm 30.

Actuation of switch 68 provides a momentary signal input to a latching circuit 72. This results in a signal input to a delay circuit 74, so that after a fixed period of time following actuation of the switch 68, there is an arming signal input to a second latching circuit 76.

The motion detector 32 generates a signal output whenever movement is detected. This signal is also an input to the latching circuit 76. For an output signal to be generated by the latching circuit 76, both an arming signal and a motion signal input are required. When this occurs, there is an output to a second delay circuit 78. Following the delay period of the circuit 78, there is an alarm signal output which operates to close an electronic switch 80, thereby energizing the alarm 30.

The disarming switch would be actuated only after actuation of the arming switch. It can be actuated either to permit the brief case to be carried, to prevent a flase alarm, or to shut of the alarm 30 after it has been energized.

Actuation of the switch 70 cancels the output of the latching circuit 72, bypasses the delay mechanism of circuit 74 and cancels the arming signal input to the latching circuit 76. The input to the second delay circuit is canceled. Again the delay mechanism is bypassed and the arming signal output of the circuit 78 is canceled to deenergize the alarm 30. In effect, there is a disarming signal which cancels the output of circuit 78, substantially instantaneously upon actuation of switch 70.

The delay circuits facilitate use of the present security device. Thus the delay in the arming signal (delay 74) allows the user to actuate the switch 68 and then have time to move the brief case to a desired storage position, without having the alarm sound. A delay period of about ten seconds has been found appropriate for this purpose.

The delay in the alarm signal (delay 78) facilitates retrieval of the brief case from a stored position. Thus the brief case may be picked up, set on a counter and then the switch 70 actuated. The disarming signal will cancel the output of the delay circuit 78 before expiration of the delay period, following an input from the latching circuit 72, which would have been generated in response to a motion signal input upon initial movement of the brief case for its retrieval. Also, if an inadvertent movement of the brief case is observed, switch 70 can be actuated to prevent a false sounding of the alarm 30. A delay period of approximately five seconds for the alarm signal has been found satisfactory for these purposes.

The details of an operative circuit for carrying out these functions, will now be described with reference to FIG. 11.

This circuit employs two integrated circuit chips IC1 and IC2, which are CMOS (complementary Metal Oxide) chips available by the designation 4093 chips. Each chip comprises four NAND logic gates. Appropriate pin connections are provided on the chips for connection of inputs thereto and connection with outputs therefrom, as well as for connection across a power source, all as is well known to one skilled in the art.

Logic devices of the present type are binary in character. That is, they are responsive to inputs having a given threshold value and to signals of a lesser value. Similarly the outputs of these logic devices alternate between the threshold value and ground. The threshold value is commonly referenced as a "high", or, by binary convention, "1". The alternate signal value is commonly referenced as a "low" or, by binary convention, "0".

NAND gates comprise two signal inputs and a single output. The logic characteristic of this device is that a "0" output is obtained only when both signal inputs are "1", or highs. If either, or both of the inputs are "0", then the output is "1", i.e., a high.

The signal generating portion of the control circuit is powered by the battery 36. The positive side of the battery is connected to a conductor 82 through a switch 84. The switch 84 would be open when the anti-theft device is not to be used for an extended period of time. This is a preferred feature in that, as will appear, there would otherwise be a small current drain, even though this drain is at a minimal level through the preferred use of CMOS chips.

With the switch 84 closed, the chips IC1 and IC2 are connected across the battery 36 by pin connections indicated at gates IC1-A and IC1-B, and IC2-A and IC2-B. Also arming switch 68 is in its normally closed position completing a circuit to ground through resistor 86. Further, the conductive elements of the motion detector 32 are connected across the battery 36, in series with a variable resistor 88.

The latching circuit 72 comprises NAND gates IC1-A and IC1-B connected in flip flop fashion. In the unarmed condition, a "1" signal exists on the (a) input to gate IC1-A, through the normally closed arming switch 68. A "1" signal is also at the (b) input to gate IC1-B, by way of the connection to the positive voltage conductor 82, through resistor 90. The output of gate IC1-B is connected, by conductor 92, to the (b) input for gate IC1-A and the output of gate IC1-A is connected to the input (a) of gate IC1-B, by conductor 94. In the unarmed condition of the circuit, the output of gate IC1-B is "1" and the output of gate IC1-B is "0".

To arm the anti-theft device, switch 68 is actuated to momentarily open the connection of input IC1-A(a) to the high voltage conductor 82. The (a) input is reduced to a ground or "0" value, through resistor 86. With a "0" (b) input to IC1-A its output is switched to a positive or "1" value. This "1" value then becomes the (a) input to IC1-B and, both inputs being "1", the output becomes "0" as does the (b) input to IC1-A. Thus, when switch 68 is released and recloses, to reimpose a "1" signal to the (a) input of IC1-A, the "0" input at IC1-A(b) maintains a "1" output from gate IC1-A.

The output signal from the latching circuit is fed to the delay circuit 74 by conductor 96. The signal passes serially through a current limiting resistor 98, a diode 100 and a variable resistor 102 to the (a) input of NAND gate IC1-C. A capacitor 104 is connected to this (a) input, across ground. The (b) input to gate IC1-C is permanently maintained at a "1" value, through current limiting resistor 106, connecting with the positive voltage conductor 82.

When unarmed, the (a) input to IC1-C is "0" and its output is "1". In response to actuation of the switch 68, there is a positive or "1" input to the delay circuit 74. Resistor 98, the active portion of resistor 102 and capacitor 104 provide a time delay for the voltage on the (a) input to IC1-C reaching the threshold voltage value representing a "1" signal. The resistance and capacitance value of this RC delay determine the length of time for the signal strength to reach the "1" level. This delay, as previously indicated may be in the order of 10 seconds.

At the expiration of the delay period, a "1" signal is imposed on input (a). Both inputs to IC1-C being positive, its output then switches to a "0" value.

The output of the IC1-C gate is fed to both inputs of NAND gate IC1-D. Thus, when the output of IC1-C is switched from "1" to "0", the output of IC1-D switches from "0" to "1". Gate IC1-D functions as an inverter. Its purpose being simply to make the arming signal a positive or "1" value for convenience in designing the remaining components of the circuit. The output from gate IC1-D is then fed to the second latching circuit 76 by way of conductor 108. The LED 42 is connected to conductor 108 through resistor 109 and is illuminated when the circuit is thus armed.

The latching circuit 76 is also a flip flop circuit, comprising NAND gates IC2-A and IC2-B. The output of gate IC2-A is connected to the (a) input of gate IC2-B by conductor 110.

The output of IC2-B is connected to the (b) input of IC2-A through conductor 112. The (a) input to IC2-A is conductor 60 from the motion detector 32. The (b) input to gate IC2-B is conductor 108.

In its unarmed condition, there is a "0" signal at the (b) input to IC2-B, which is connected to ground through resistor 114. The output of IC2-B is thus a "1"

value, as is input (b) of IC2-A. The (a) input to IC2-A is also at a "1" value. This results from its connection with the positive voltage conductor 82, made through the conductive elements of the motion detector 32, these elements then being connected to ground through the variable resistor 88.

In accordance with previous teachings herein, when there is movement of the motion detector 32, there is relative movement between the sphere 52 and screen 62. This relative movement results in an increase in the contact resistance between the sphere 52 and the screen 62.

It is initially assumed that when the sphere is at rest, there is essentially no intersurface contact resistance, or voltage drop in current flow between the sphere and screen (there would be some minimal amount). The contact resistance and the resistor 88 form a variable voltage divider from which the IC2-A(a) input is derived.

When there is a movement related increase in this resistance, there will be a sufficient voltage drop across this contact resistance that the voltage level at input (a) for IC2-A falls below the threshold value for a "1" signal and the input thus becomes "0". Likewise, if the sphere loses contact with the screen, there is, in effect, an infinitely high increase in contact resistance. Input (a) of IC2-A is then immediately grounded to a "0" value through the resistor 88.

At this point it will be noted that variable resistor 88 provides means for adjusting the sensitivity of the present device. The contact resistance (of detector 32) and resistor 88 being in series, the higher the value of resistor 88, the less the voltage drop across the contact between the sphere and the screen.

The decrease in voltage at input (a), is directly proportional to increases in contact resistance, and is also inversely proportional to the value of resistor 88. Thus the higher the value of resistor 88, the greater the increase in contact resistance (as reflected by sphere movement) required to provide a "0" signal for input (a). The value of resistor 88 is adjusted to provide a desired level of sensitivity, so that the alarm will not be sounded because of vibrations or other movements not associated with theft.

In the unarmed condition of the circuit, the output of gate IC2-A will switch between "0" and "1" when movement of the detector occurs. The output of gate IC2-B will remain at a "1" value due to the "0" signal at IC2-B(b), being thus, non-responsive to the motion signal inputs.

However, once there is an arming signal input, reflected by a "1" signal to IC2-B(b), when an increase in detector resistance next causes the output of IC2-A to switch to a positive "1" value, both inputs to IC2-B will be positive and its output will switch to a "0" value. Simultaneously the input to IC2-A(b) will switch to a "0" value, thus latching the output of IC2-A to a "1" value when movement of the detector ceases and the input IC2-A(a) reverts to a "1" value.

The output of latching circuit 76 is fed as a common signal to both inputs of NAND gate IC2-C. Thus the motion responsive output signal from the latching circuit is a switch to a "0" signal. Gate IC2-C simply reverses this signal to a "1" value for simplification of circuit design.

The output of IC2-C is fed, by conductor 118 to the second delay circuit 78, which is identical with the delay circuit 74, excepting that component values may be varied to obtain a shorter time delay. Thus, the positive signal output from IC2-C passes through resistor 120, diode 122 and variable resistor 124 with capacitor 126 providing a delay function for input IC2-D(a) reaching the threshold "1" value. Input IC2-D(b) is maintained at a "1" value through resistor 128. The output from delay 78 is thus a switch to a "0" output.

This output is fed to switch 80 which comprises a power transistor 130 the collector and emitter of which are connected in series with the positive side of the battery 36, the alarm 30 and the battery 38. In the absence of an motion signal output from the latching circuit 76, the output for IC2-D is "1" or positive. This potential is imposed, through resistor 132 on the base of transistor 130, biasing it to a non-conductive state.

When there is an alarm signal output from the delay 78, i.e., when the output of IC2-D switches to a "0" or ground value, the bias on the base of transistor 130 is removed and it switches to a conductive state thereby energizing the alarm 30.

Figure 11:
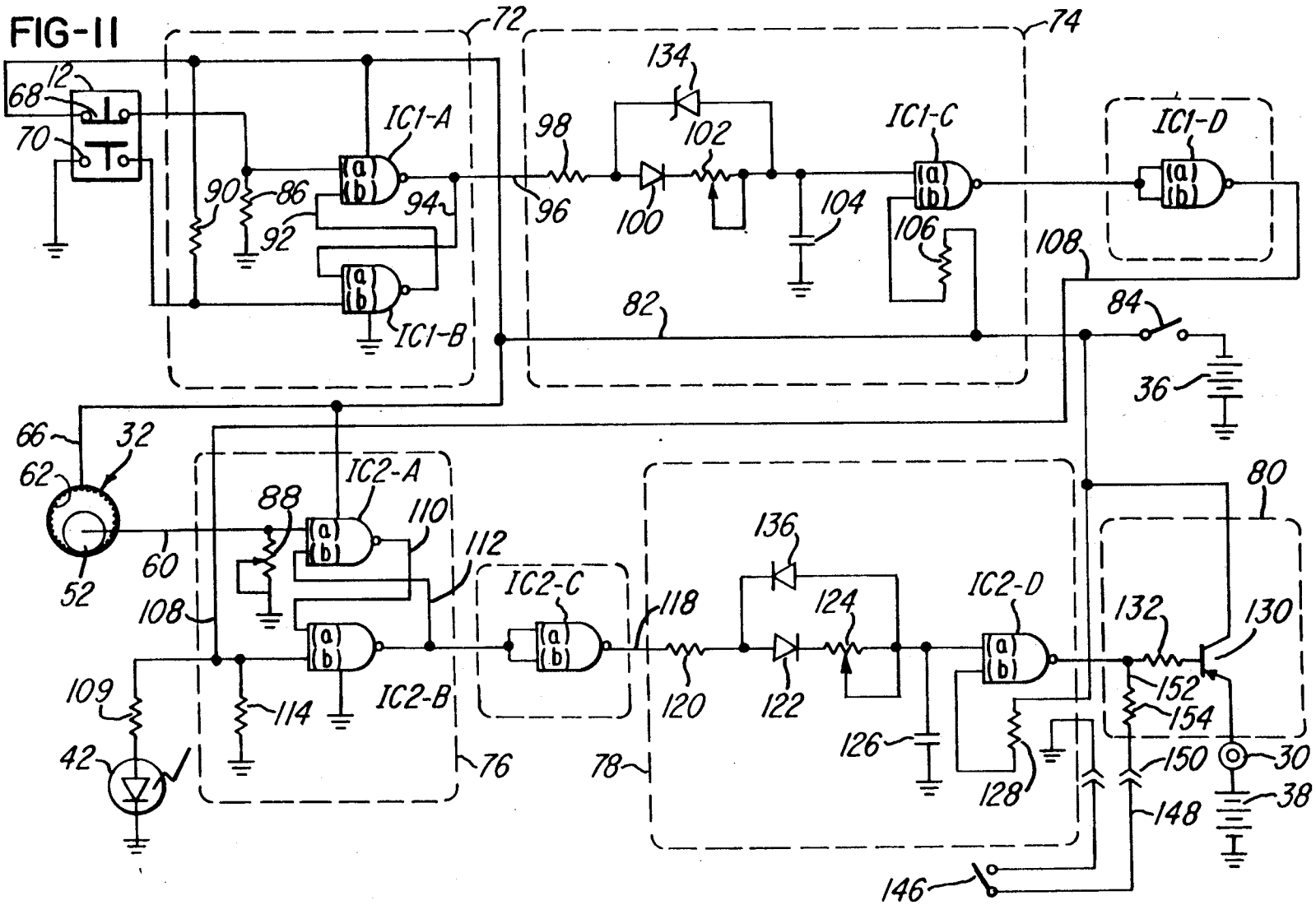
FIG. 11 is a schematic diagram of the electrical/electronic components providing the functions of FIG. 10.

In the circuit of FIG. 11, provision is made for deenergizing the alarm 30 by actuating the key pad switch 70. When this is done, the (b) input of gate IC1-B is grounded and switched to a "0" value. The output of IC1-B is switch to a "1" value. Both inputs to IC1-A are "1" and its output is switched to a "0" value, which becomes the (a) input to IC1-B. The circuit is thus latched into an unarmed condition, until a subsequent actuation of switch 68.

The ground input signal to the delay circuit 74 passes through diode 134, bypassing the variable resistor 102, which is the major resistance factor providing the time delay. Thus, with inconsequential delay, the (a) input for IC1-C drops below its threshold "1" level. The outputs of IC1-C and IC1-D thus, respectively switch to "1" and "0" values.

There is thus a "0" signal to the IC2-B(b) input as in the previously described, unarmed condition of the latching circuit 76.

The input to delay circuit 78 switches to a negative value. This negative, disarming signal, in effect, flows through a diode 136, bypassing the variable resistor 124. Thus, again with inconsequential delay, the (a) input to IC2-D drops below its threshold "1" value to a "0" input. The output of IC2-D switches to a positive "1" value biasing the transistor 130 to a non-conductive state and deenergizing the alarm 30.

Actuation of the switch 70, in effect, generates the disarming signal. The disarming signal passes through the several components of the circuitry to the (a) input of IC2-D. Because of the bypassing diodes 134, 136 and threshold voltage requirements for a "1" signal, the output of IC2-D is rendered, or maintained at a positive or "1" value, substantially instantaneously upon actuation of the switch 70. Thus it is possible to retrieve the brief case without the alarm sounding, or to prevent energization of the alarm, where it is recognized that inadvertent movement of the brief case has occurred.

Design of the circuit for providing the described functions is well within the ability of one skilled in the art, and alternate circuits, based on a resistance motion signal, can provide the same ends herein described.

For sake of illustration, the following component values have been found effective, used in combination with two RCA 4093 integrated circuit chips.

| Component | | Value |
|---|---|---|
| Resistors: | 86, 98, 132 | 10,000 ohms, ¼ watt |
| | 102, 124 | 500,000/1,000,000 ohms ¼ watt |
| | 106, 114, 120, 128, 154 | 470,000 ohms, ¼ watt |
| | 116 | 5,000/15,000 ohms, ¼ watt |
| | 109 | 560,000, ¼ watt |
| Capacitors: 104, 126 | | 4.7 ufd, 35 volts |
| Diodes: 100, 122, 134, 136 | | 1N914 |
| Transistor: 130 | | 2N4403 |
| Batteries: 36, 38 | | 9 volts |

Figure 8:
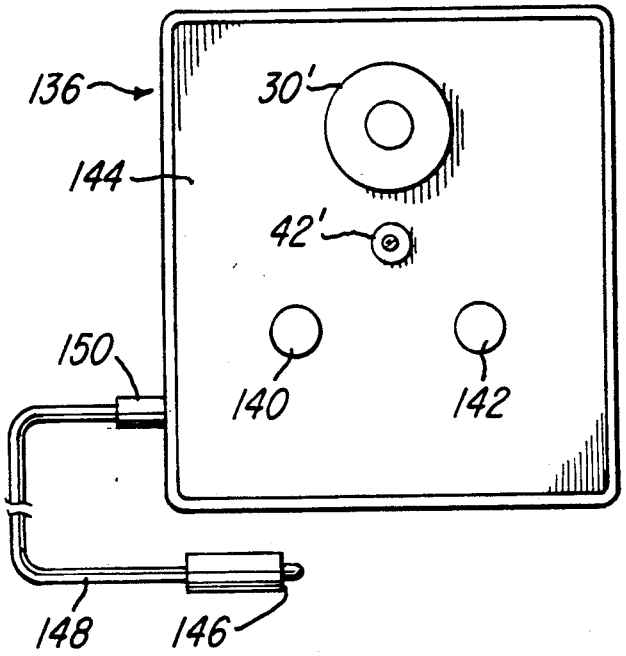
FIG. 8 is a plan view of an alternate embodiment of the invention.
Figure 9:
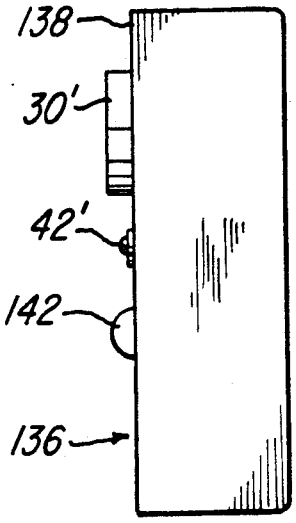
FIG. 9 is a side view of the embodiment seen in FIG. 8.

Reference is next made to FIGS. 8 and 9 for a description of an alternate embodiment of the invention, which is a security device generally identified by reference character 136. The device 136 is particularly adapted for protecting women's purses.

The several components of the electrical circuitry, described in connection with the security device 10, including a motion detector (32) and batteries (36, 38), are mounted within a housing 138. This circuitry may be identical with that shown in, and described with reference to, FIG. 11. The arming switch (68) may be actuated through a button 140 and the disarming switch (70) may be actuated by a button 142. An led 42' is mounted on the front panel 144 of the housing 138 and is illuminated, as before, when the device is armed. When armed, movement of the device will result in the sounding of an alarm 30' mounted on the front panel 144.

One use of the device is illustrated where it is desired to place a purse on the floor or an adjacent chair during a meal in a restaurant. The purse is opened, the arming switch actuated by button 140. The arming signal delay (74) permits the purse to be closed and then placed where desired, without sounding of the alarm. When the purse is retrieved, it is opened and the disarming switch actuated through button 142. The alarm signal delay (78) enable disarming without sounding of the alarm 30'.

The device 136 further provides protection against the purse being snatched while being carried. To this end a switch 146 is provided. It is connected to the housing 138 by an insulated conductor 148 and a removable jack 150. The jack 150 permits removal of the switch and conductor cord, as illustrated in FIG. 9.

In use the housing is disposed in the purse and the conductor threaded through the purse closure so that the switch 146 can be held in the same hand carrying the purse. The device is unarmed so that the alarm will not sound in response to motion detector signals. If the purse is snatched by a thief, the person carrying it actuates the switch 146. This provides an alarm signal which energizes the alarm 30'. Thus there is an immediate sounding of the alarm, so that apprehension of the thief may more readily be effected. Actually, it is more likely that the thief will drop the purse and flee.

FIG. 10 shows the switch incorporated in the functional system of the device. Closure of the switch 146 provides an alarm signal input to the electronic switch 80. This provides an alternate means for closing the switch 80 and energizing the alarm.

FIG. 11 illustrates how the switch may be incorporated in the electrical circuit. Conductor 152 extends from the output of NAND gage IC2-D to jack 150 through resistor 154. Conductor 148 extends from jack 150, to switch 146 and then back to jack 150 to a ground connection. When switch 146 is closed, the base of transistor 130 is placed at ground value, removing the bias on the transistor and rendering it conductive to energize the alarm.

It is preferable that the switch 146 be of the single pole, single throw type. Thus, once actuated to a closed position, it remains closed until positive displaced to an open position. With this arrangement, the alarm 30' will continue to sound until deenergized by positive actuation of the switch 146. It is contemplated that means could be provided to make it unobvious as to how the switch could be actuated to an open position.

As an alternative, the switch 146 could be arranged to open the positive battery connection to the (a) input for the NAND gate IC1-A to generate an arming signal. Thereafter, the motion detector signal would generate an alarm signal in the case of a snatch theft. This alternative can also be used in combination with the described signal input directly to the switch 80.

It will be appreciated that many alternate constructions are available. For example, the container for the sphere could be spherical, as well as the preferred cylindrical configuration described. While reference has been made to an audible alarm or warning, a visual alarm, or other form of alarm could also be employed.

These and other alternatives in the described embodiments will occur to those skilled in the art, within the spirit and scope of the present inventive concepts, which are set forth in the following claims.

Having thus described the invention, what is claimed as novel and desired to be secured by Letters Patent of the United States is:

1. A motion detector comprising a container having a conductive inner surface forming a first element, a conductive member contacting said conductive inner surface and forming a second element, a tether connecting said conductive member to said container, said tether being spaced from said conductive surface and providing means mounting said elements for relative movement with respect to each other in response to movement of the container, said conductive inner surface and said tether being, respectively, connected in series across an electrical potential, whereby a motion signal is produced by an increase in resistance between said conductive member and said conductive inner surface when there is movement of said container.

2. A motion detector as in claim 1 wherein the conductive member is in the form of a sphere, and the tether is flexible, imposing minimum restraint on movement of the sphere relative to the container.

3. A motion detector as in claim 2 wherein the sphere is solid metal having a relatively large mass for minimizing the restraining effect of the tether.

4. A motion detector as in claim 2 wherein the conductive surface of the container is irregular, providing points of contact with the sphere.

5. A motion detector as in claim 2 wherein the container is a tubular cylinder having walls at its opposite ends, the conductive surface of the container extends around the inner wall of the cylinder and over the inner surface of one of end walls, the tether extends through the other of said end walls and has a length sufficient for the sphere to contact said one end wall, whereby the sphere contacts said conductive surface in any orientation of the motion detector.

6. A motion detector as in claim 5 wherein the container is formed of a dielectric material and the conductive inner surfaces thereof are formed of woven wire screening.

7. A motion detector as in claim 6 wherein the screen is formed of brass and the sphere is formed of lead.

8. A motion detector as in claim 7 wherein the inner diameter of the conductive screen which extends around the inner wall of the cylinder is between about 1.5 to 1.75 times the diameter of the sphere, and the inner length of the cylinder is between about 1.5 to 2 times the diameter of the sphere.

9. A motion detector as in claim 5 wherein the inner diameter of the conductive cylinder surface is between about 1.5 to 1.75 times the diameter of the sphere, and the inner length of the cylinder is between about 1.5 to 2 times the diameter of the sphere.

10. A motion detector as in claim 2, forming a security device in further combination with an alarm and an electrical circuit for energizing the alarm, said electrical circuit including an electrical potential across which the tether, sphere and container conductive surface are connected in series relation, and means, responsive to an increase in electrical resistance, of the contacting surfaces of the container and sphere, which results from movement of said detector, for energizing said alarm.

11. A security device as in claim 10, further comprising a resistor connected in series relation with the conductive components of the detector and forming a voltage divider in combination with resistance of said contacting surfaces, and the means for energizing the alarm derive an input intermediate said resistor and said contacting surfaces and are responsive to a change in voltage resulting from an increase in contact resistance and voltage drop thereacross, and means for varying the value of said resistor to thereby change the extent to which the voltage input for the alarm energizing means varies for a given change in contact resistance, and thus adjust the sensitivity of the device.

12. A security device as in claim 10, wherein the means responsive to an increase in resistance, include means for latching the alarm in an energized condition upon a single increase in resistance resulting from sphere movement, and the electrical circuit further includes separately actuable means for deenergizing the alarm.

13. A security device as in claim 12, wherein the means for energizing the alarm require an arming signal for operability, and the electrical circuit further includes an arming switch, means responsive to actuation of said arming switch for generating said arming signal and means for delaying transmission of said arming signal to said alarm energizing means for a predetermined time after actuation of said arming signal, whereby, the motion detector can be moved to a desired position, after arming, without energization of the alarm.

14. A security device as in claim 13 further including means for delaying energization of said alarm until a fixed period of time after an increase in resistance resulting from sphere movement and wherein the deenergizing means are effective substantially immediately upon actuation, whereby, the security device may be moved for purpose of disarming, without energizing the alarm.

15. A security device as in claim 10, further comprising separate, manually actuated means for independently energizing said alarm.

16. A security device as in claim 15 further comprising a housing in which and on which the alarm, the electrical circuit, arming and disarming switches are mounted, and the separate actuating means include a flexible conductor extending from said housing and a switch disposed at the end of said conductor.

17. A brief case, in combination with a security device, said brief case having opening-defining portions movable between a juxtaposed, closed position and a spaced, open position, said security device comprising an alarm, a motion detector and electrical means for energizing the alarm in response to a motion signal from said detector, switch means for controlling said electrical means, and conductor means interconnecting said switch means and electrical means, characterized in that the switch means are detachably mounted on the exterior of said brief case, the alarm, the motion detector and the electrical means are detachably mounted interiorly of said brief case, and the conductor means extends between the juxtaposed portions of the brief case in their closed position, whereby the security device may be removed from the brief case and used in combination with another brief case or for other security purposes.

18. A combination as in claim 17 further comprising a housing within which the alarm, motion detector and electrical means are mounted, and the switch means comprises a key pad, and the conductor is in the form of a ribbon conductor extending between the key pad and housing, and further wherein means are provided for detachably mounting the key pad and the housing.

19. A combination as in claim 18 wherein the detachable mounting means comprise fabric patches having intermeshing elements, and patches are respectively adhered to the key pad, housing and interior and exterior surfaces of the brief case for the detachable mounting of these components.

20. A combination as in claim 18 wherein the brief case comprises an open shell having a top panel providing one of said opening defining portions, with an edge thereof being in said juxtaposed position with the other edge defining portion in said closed position, further characterized in that the key pad is disposed on the exterior surface of the top panel, adjacent said edge, and the housing is disposed on the interior surface of the top panel, adjacent said edge.

* * * * *